US006641471B1

(12) United States Patent
Pinheiro et al.

(10) Patent No.: US 6,641,471 B1
(45) Date of Patent: Nov. 4, 2003

(54) POLISHING PAD HAVING AN ADVANTAGEOUS MICRO-TEXTURE AND METHODS RELATING THERETO

(75) Inventors: Barry Scott Pinheiro, Media, PA (US); Steven Naugler, Hockessin, DE (US)

(73) Assignee: Rodel Holdings, INC, Wilmington, DE (US)

( * ) Notice: Subject to any disclaimer, the term of this patent is extended or adjusted under 35 U.S.C. 154(b) by 250 days.

(21) Appl. No.: 09/693,401

(22) Filed: Oct. 20, 2000

Related U.S. Application Data

(60) Provisional application No. 60/233,747, filed on Sep. 19, 2000.

(51) Int. Cl.[7] ..... B24D 17/00

(52) U.S. Cl. ..... 451/526; 451/56; 451/443

(58) Field of Search ..... 451/921, 443, 451/526, 530, 533, 296, 307, 168, 56; 51/298

(56) References Cited

U.S. PATENT DOCUMENTS

| | | | | |
|---|---|---|---|---|
| 5,081,051 A | | 1/1992 | Mattingly et al. | |
| 5,489,233 A | | 2/1996 | Cook et al. | |
| 5,569,062 A | | 10/1996 | Karlsrud | |
| 5,990,010 A | | 11/1999 | Berman | |
| 6,022,268 A | * | 2/2000 | Roberts et al. | 451/548 |
| 6,354,930 B1 | * | 3/2002 | Moore | 451/527 |

FOREIGN PATENT DOCUMENTS

| | | |
|---|---|---|
| WO | WO 98 45087 | 10/1998 |
| WO | WO 99/33615 A1 | 7/1999 |

OTHER PUBLICATIONS

Stein, Davis; Heterington, Dale;Dugger, Mike; Stout, Tom, "Optical Interferometry for Surface Measurements of CMP Pads", Journal of Electronic Materials, vol. 25, No. 10, Oct. 1996, pp. 1623–1627.

* cited by examiner

*Primary Examiner*—Robert A. Rose
(74) *Attorney, Agent, or Firm*—Anuradha Ramana; Blake T. Biederman

(57) ABSTRACT

A statistically uniform micro-texture on a polishing pad surface improves break-in preconditioning time, and is measured by:

Land Surface Roughness, Ra, from about 0.01 $\mu$m to about 25 $\mu$m;

Average Peak to Valley Roughness, Rtm, from about 2 $\mu$m to about 40 $\mu$m;

Core roughness depth, Rk, from about 1 to about 10;

Reduced Peak Height, Rpk, from about 0.1 to about 5;

Reduced Valley Height, Rvk, from about 0.1 to about 10; and

Peak density expressed as a surface area ratio, $R_{SA}$, ([Surf.Area/(Area−1)]), 0.001 to 2.0.

47 Claims, 4 Drawing Sheets

Figure 1. Bearing Ratio Curve

Figure 2. Single-Point Cutting Tool

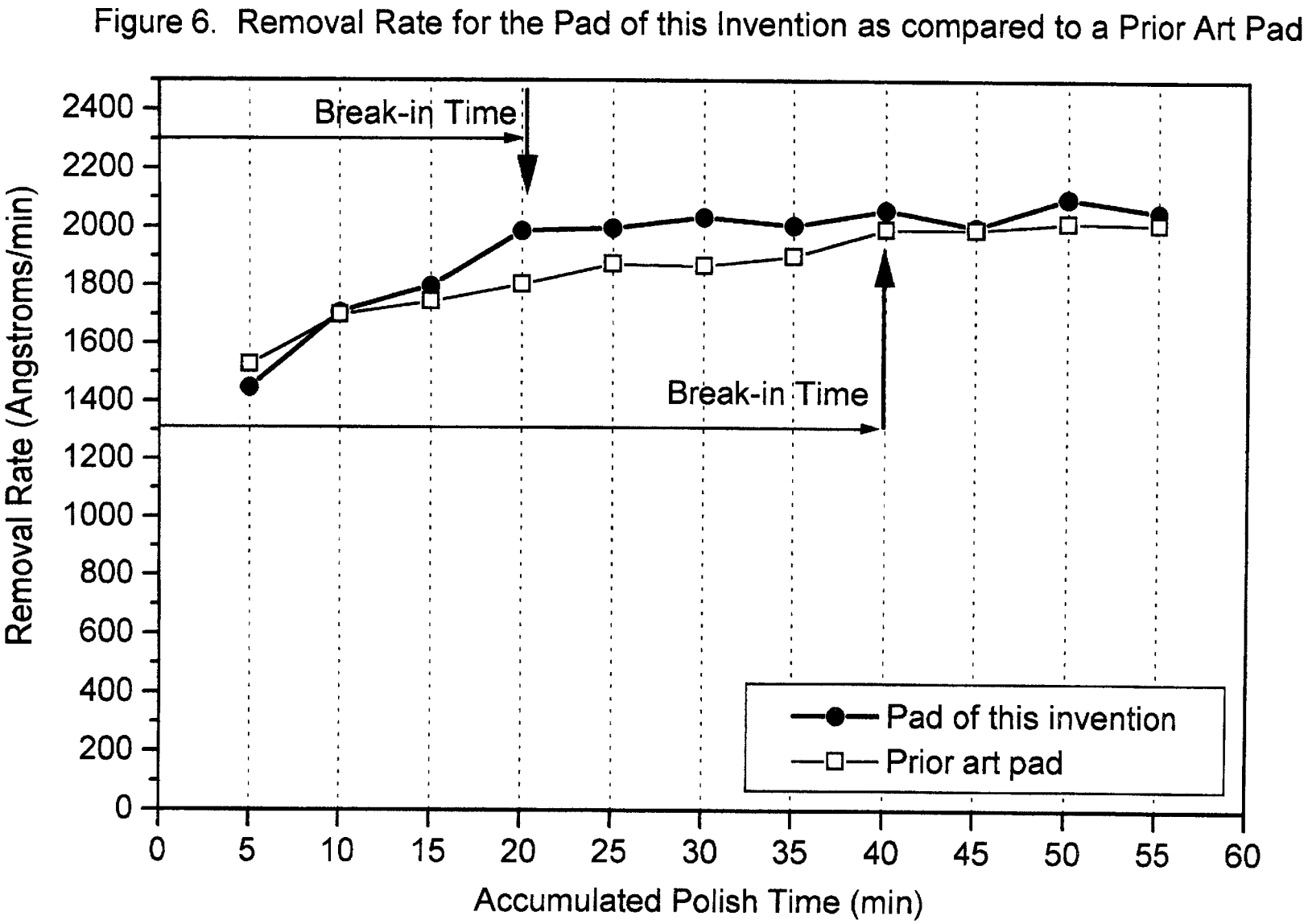
Figure 6. Removal Rate for the Pad of this Invention as compared to a Prior Art Pad

POLISHING PAD HAVING AN ADVANTAGEOUS MICRO-TEXTURE AND METHODS RELATING THERETO

This application claims the benefit of U.S. Provisional Patent Application Serial No. 60/233,747 filed Sep. 19, 2000.

This invention relates generally to polishing pads used for creating a smooth, flat surface on substrates such as glass, semiconductor device wafers, and/or dielectric/metal composites; more specifically, the composition and methods of the present invention are directed to the polishing surface topography of such pads prior to their use in polishing such substrates. Applications especially adapted for use of the present invention include the polishing/planarization of substrates such as silicon, silicon dioxide, tungsten, and copper encountered in integrated circuit fabrication.

U.S. Pat. No. 5,569,062 describes a cutting means for abrading the surface of a polishing pad during polishing. U.S. Pat. No. 5,081,051 describes an elongated blade having a serrated edge pressing against a pad surface, thereby cutting circumferential grooves into the pad surface.

U.S. Pat. No. 5,990,010 describes a preconditioning mechanism or apparatus for preconditioning a polishing pad. This apparatus is used to generate and re-generate micro-texture during polishing pad use.

In semiconductor wafer polishing processes, initial preconditioning of the polishing pad, (also referred to as "break-in"), is distinguished from the in-process conditioning of a pad that has already undergone pre-conditioning. In-process conditioning can be concurrent with polishing or intermittently performed on a polishing apparatus between polishing cycles. In general, the initial "start-up" period for a polishing pad can be described as the accumulated polish time required for the removal rate of the substrate (or workpiece) material to level off to a stable steady-state removal rate for a particular type of pad. Preconditioning polishing pads addresses the problems associated with the "start-up" period.

In conventional wafer production, chemical-mechanical polishing conditions for subsequent production wafers may be set from the results obtained from the first production wafer. However, a "first wafer effect" is encountered when a new lot of wafers undergoes polishing on a polishing pad that has been idle for a period of time or when a new (previously unused) polishing pad is installed.

The first wafer effect refers to a difference in the polishing results obtained for the first wafer compared to that obtained for subsequent production wafers. This effect is believed to be due to different polishing conditions encountered by the first wafer. One approach to reduce the first wafer effect is to utilize a blank preconditioning wafer. After preconditioning with such wafers for a certain length of time, the first production wafer is installed in the wafer holder and polished. This on-machine preconditioning procedure is not only cumbersome due to successive loading and unloading of separate cassettes containing preconditioning and production wafers but also leads to increased production costs due to machine downtime associated with preconditioning.

Micro-texture comprises micro-indentations and micro-protrusions. These micro-protrusions typically have a height of less than 50 microns and more preferably less than 10 microns. Micro-indentations have an average depth of less than 50 microns, and more preferably less than 10 microns. Macro-texture comprises both macrogrooves and micro-grooves.

Problems associated with in-process conditioning can arise from the need to determine the frequency and duration of conditioning treatment between production polishing runs. This can give rise to further variation and unpredictability due to the variation in surface textures obtained by these techniques. Additionally, in-process conditioning often does not address problems attendant with the Initial break-in period for an as-manufactured polishing pad, for e.g. a pad fabricated of polyurethane.

In the start-up of a polishing process, new pads tend to exhibit a characteristic "break-in" behavior manifested typically in a low initial rate of removal, followed by a rise in removal rate, and a leveling off to a steady-state on a polishing tool. The break-in period may last from 10 minutes to more than one hour, and represents an increasingly significant equipment efficiency loss in the industry. It has been observed that molded pads which have a smooth surface often exhibit an undesirably long, and/or inconsistent break-in time from pad-to-pad or lot-to-lot of polishing pads. On the other hand, a polishing pad that has been over-conditioned may exhibit an initially high unstable removal rate before leveling off to a steady state value. This deviation also contributes to a longer than desired break-in period.

It would be desirable to provide an as-manufactured polishing pad with a shorter and/or more consistent break-in period, with improved predictability in removal rate and/or an increased steady-state removal rate, as compared to manufactured polishing pads of the present state of the art.

A certain degree of texture is generally required for a polishing pad to perform adequately. This surface texture, consisting of peaks (or protrusions) and valleys (or indentations) often aids polishing in the following ways: 1) the valleys act as reservoirs to hold "pools" of polishing slurry so that a constant supply of slurry is available for contact with the surface of the substrate being polished; 2) the peaks come in direct contact with the substrate surface causing "two-body abrasive wear" and/or in conjunction with the slurry particles causing "three-body abrasive wear"; and 3) the texture of the surface acting in conjunction with the shear on the slurry causes eddy currents in the slurry creating wear of the substrate surface by erosion.

It is common practice to use a single number (an "Ra" number) to characterize surface roughness. Ra describes the average deviation of the pad surface from the average amplitude/height of the surface features. Since two drastically different surfaces could have the same Ra values, additional parameters are necessary to better quantify polishing surface micro-texture. Some additional useful parameters are: Average Peak to Valley Roughness ("Rtm"); Peak Density ("$R_{sa}$"); Core Roughness Depth ("Rk"); Reduced Peak Height ("Rpk"); and Reduced Valley Height ("Rvk").

Peak density indicates how may peaks (protrusions) are available to be in contact with the surface of the substrate being polished. For a given downforce on the pad (the pressure with which the substrate is contacted with the polishing layer of the polishing pad) a low peak density would have fewer contact points and thus each contact point would exert greater pressure on the substrate surface. In contrast, a higher peak density would imply numerous contact points with almost uniform pressure being exerted on the substrate surface. Peak density is characterized through the surface area ratio ("$R_{SA}$") which is defined as [Surface Area/(Normal Area−1)], wherein, surface area is the measured surface area, and normal area is the area projected on a normal plane.

Average Peak to Valley Roughness ("Rtm") is a measure of the relative number of peaks and valleys. Peak to valley height characterizes both the height of the peaks and the depth of the valleys in the surface texture. The thickness of the slurry layer (and/or depth of a local pool of slurry) influences the dynamics of slurry and particle flow within the slurry, i.e. whether the flow is laminar or turbulent, the aggressiveness of the turbulence, and the nature of eddy currents. The dynamics of slurry flow is important as it relates to the "erosion wear" mechanism of polishing.

Valley size will indicate the ability of the surface to retain "pools" of slurry as well as the quantity of slurry locally available to perform the polishing. As a relatively large wafer (200 to 300 mm in diameter) passes over a polishing pad it is important to have the slurry available at all points under the wafer to ensure uniformity of polishing. If the polishing pad were featureless it would be difficult for the slurry to penetrate under the wafer to be available in the interior portions of wafer. In this scenario, the contact area between the pad and the wafer becomes "slurry starved". This is the motivation for polishing pads with grooves or perforations. Macroscopic features such as grooves enable slurry flow between the polishing layer of the polishing pad and the wafer. As we focus on smaller dimensions on a polishing pad, in the range of 0.5–25 mm, (i.e. the land area between grooves or perforations), if the surface of this land area is too smooth (analogous to a featureless pad on a larger size scale), the local area of contact between the pad and wafer can similarly become slurry starved. It is therefore important to have a smaller scale surface texture (i.e, micro-texture) which is capable of locally retaining slurry to make it available on these smaller size scales.

Lastly, in addition to the reasons listed above, peak size is important because it affects the rigidity of that peak; a tall narrow peak will be more flexible than a broader one. The relative rigidity of a peak affects the influence of the abrasive wear component of the polishing. Peak and valley size and shape are cooperatively characterized through $R_{pk}$ (reduced peak height), $R_{vk}$ (reduced valley depth), and $R_k$ (core roughness depth). These three values are obtained from the bearing ratio curve, as shown in FIG. 1. The bearing ratio is used in tribological studies. More details may be found in "Tribology: Friction and Wear of Engineering Materials, I. M. Hutchings, page 10, 1992. The relevant text from this textbook is presented here for easy reference: "The bearing ratio curve can be understood by imagining a straight line, representing the profile of the surface under investigation. When the plane first touches the surface at a point, the bearing ratio (defined as the ratio of the contact length to the total length of the profile) is zero. As the line is moved further downwards, the length over which it intersects the surface profile increases, and therefore the bearing ratio increases. Finally, as the line reaches the bottom of the deepest valley in the surface profile, the bearing ratio rises to 100%." The bearing ratio curve is a plot of bearing ratio against surface height, as shown in FIG. 1.

The present invention provides a polishing pad having a pre-texturized surface (surface micro-texture or microtopography). The micro-texture on the polishing pad according to the present invention is fabricated prior to polishing, preferably during manufacturing, as distinguished from the in-process conditioning methods discussed in prior art. The pad surface is comprised of macro-texture (grooves) and micro-texture mechanically produced-upon the entire pad working surface (also referred to herein as the surface of the polishing layer). The micro-texture is statistically uniform over the entire pad surface and is described by the following quantitative parameters:

Arithmetic Surface Roughness, Ra, from 0.01 $\mu$m to 25 $\mu$m;
Average Peak to Valley Roughness, Rtm, from 2 $\mu$m to 40 $\mu$m;
Core roughness depth, Rk, from 1 to 10;
Reduced Peak Height, Rpk, from 0.1 to 5;
Reduced Valley Height, Rvk, from 0.1 to 10; and
Peak density expressed as a surface area ratio, $R_{SA}$, ([Surf.Area/(Area−1)]), 0.001 to 2.0.

In one embodiment, the present invention provides a homogeneous or non-homogeneous polymeric polishing pad, conditioned prior to use, which generally exhibits a shorter break-in time compared to many prior art as-manufactured polymeric polishing pads.

In another embodiment, the present invention provides an improved break-in time and removal rate relative to many prior art pads.

For the purpose of illustrating the present invention, the following drawings are provided. However, the invention is not limited to the specific embodiments disclosed.

FIG. 6 is a plot of the removal rate (y-axis) of a wafer oxide layer in Angstroms per minute, against the accumulated polishing time in minutes (x-axis) for an as-manufactured untreated pad and an as-manufactured pad according to the invention.

Figure 1:
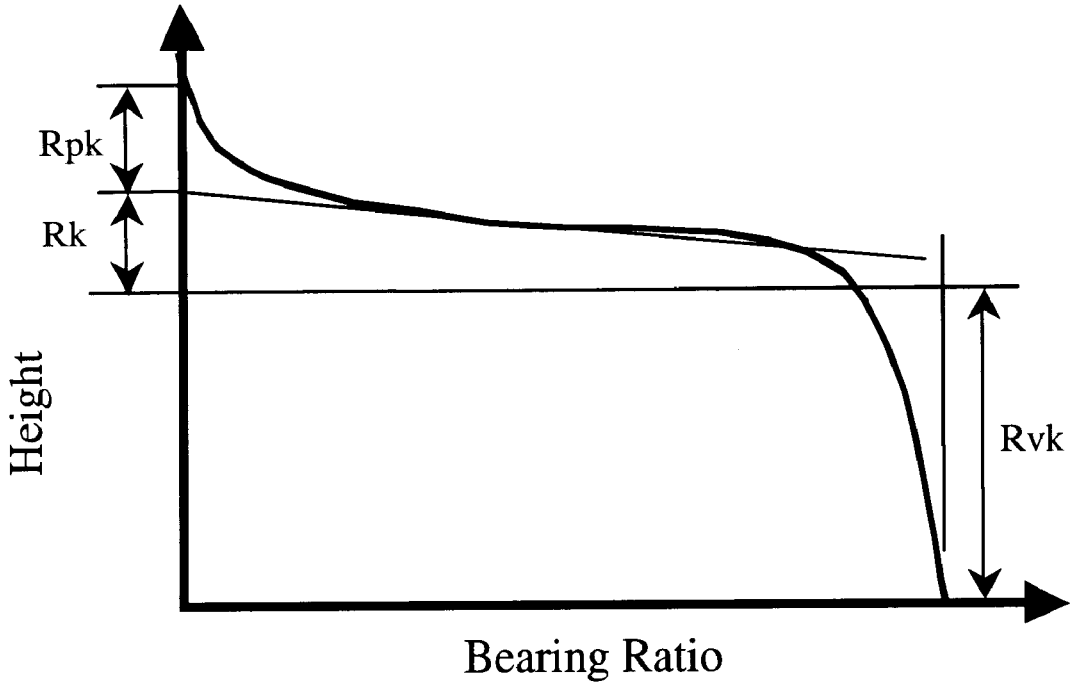
FIG. 1 shows the bearing ratio curve.

The preferred polishing pads of the present invention comprise a solid thermoplastic polymer or thermoset polymer. The polymer may be selected from any one of a number of materials, including polyurethane, polyurea-urethane, polycarbonate, polyamide, polyacrylate, polyester and/or the like. Pads comprising polyester contain a homopolyester, a copolyester, a mixture or blend of polyesters or a polyester blend with one or more polymers other than polyester. Typical polyester manufacturing is via direct esterification of a dicarboxylic acid such as terephthalic acid (TA) with a glycol such as ethylene glycol (EG) (primary esterification to an average degree of polymerization (DP) of 2 to 3) followed by a melt or solid stage polymerization to a DP which is commercially usable (70 DP or higher). The phthalate-based polyesters are linear and cyclic polyalkylene terephthalates, particularly polyethylene terephthalate (PET), polypropylene terephthalate (PPT), polybutylene terephthalate (PBT), polyethylene-1,4-cyclohexylene-dimethylene terephthalate (PETG), polytrimethylene terephthalate (PTT), polyamide-block-PET, and other versions, e.g., random or block copolymers thereof containing one or more of the above components. Copolyesters are generally copolymers containing soft segments, e.g., polybutylene terephthalate (PBT) and hard segments, e.g., polytetramethylene ether glycol terephthalate. Phthalate-based polyester and co-polyesters are commercially available from du Pont de Nemours, Inc., Wilmington, Del., USA, under the Trevira®, Hytrel® and Riteflex® trademarks.

Reaction injection molding or "RIM", as is understood in the art generally involves mixing reactive liquid (or semi-liquid) precursors which are then rapidly injected into the mold. Once the mold is filled, the reactive precursors react chemically, causing solidification of a final molded product. This type of injection molding can be advantageous, because the pad's physical properties can be fine tuned by adjusting the reactive chemistry. In addition, reaction injection molding generally uses lower viscosity precursors than thermoplastic injection molding, thereby allowing for easier filling of high aspect ratio molds.

Urethane prepolymers are a useful reactive chemistry for reaction injection molding in accordance with the present invention. "Prepolymers" are intended to mean any precursor to the final polymerized product, including oligomers or monomers. Many such prepolymers are well known and commercially available. Urethane prepolymers generally comprise reactive moieties at the ends of the prepolymer chains. A common reactive moiety for a urethane prepolymer is isocyanate. Commercially available isocyanate prepolymers include di-isocyanate prepolymers and tri-isocyanate prepolymers. Examples of di-isocyanate polymers include toluene diisocyanate and methylene diisocyanate. The isocyanate prepolymer preferably comprises an average isocyanate functionality of at least two. An average isocyanate functionality greater than 4 is generally not preferred, since processing can become difficult, depending upon the molding equipment and process being used.

The isocyanate prepolymer is generally reacted with a second prepolymer having an isocyanate reactive moiety. Preferably, the second prepolymer comprises, on average, at least two (2) isocyanate reactive moieties. Isocyanate reactive moieties include amines, particularly primary and secondary amines, and polyols; preferred prepolymers include diamines, diols and hydroxy functionalized amines. In addition, abrasive particles may be incorporated into the pad material. A polishing pad with abrasives incorporated into the pad material can be utilized with an abrasive-free polishing fluid for polishing a specific substrate.

Any polymer chemistry could be used to make the polymeric polshing pads of this invention, particularly where the final product exhibits the following properties: a density of greater than 0.5 g/cm$^3$, more preferably greater than 0.7 g/cm$^3$, and yet more preferably greater than about 0.9 g/cm$^3$; a critical surface tension greater than or equal to 34 milliNewtons per meter; a tensile modulus of 0.02 to 5 GigaPascals; hardness of 25 to 80 Shore D; a yield stress of 300 to 6000 psi.; a tensile strength of 500 to 15,000 psi., and an elongation to break up to 500%. These properties are possible for a number of materials useful in injection molding and similar-type processes, such as: polycarbonate, polysulfone, nylon, ethylene copolymers, polyethers, polyesters, polyether-polyester copolymers, acrylic polymers, polymethyl methacrylate, polyvinyl chloride, polycarbonate, polyethylene copolymers, polyethylene imine, polyurethanes, polyether sulfone, polyether imide, polyketones, and the like, including photochemical reactive derivatives thereof.

A catalyst is often necessary to decrease the polymerization reaction time, particularly the gel time and the de-mold time. However, if the reaction is too fast, the material may solidify or gel prior to complete filling of the mold. Gel time is preferably in the range of about half second to 60 minutes, more preferably in the range of about 1 second to about 10 minutes, and yet more preferably in the range of about 2 seconds to 5 minutes.

Preferred catalysts are devoid of transition metals, particularly zinc, copper, nickel, cobalt, tungsten, chromium, manganese, iron, tin, or lead. The most preferred catalyst for use with a urethane prepolymer system comprises a tertiary amine, such as, diazo-bicyclo-octane. Other useful catalysts include, organic acids, primary amines and secondary amines, depending upon the particular reactive chemistry chosen.

Exemplary polymeric materials that exhibit an adequate surface tension and are usable in the polishing layer of the polishing pad and/or the pad matrix are:

| Polymer class | Typical surface tension |
|---|---|
| Polybutadiene | 31 |
| Polyethylene | 31 |
| Polystyrene | 33 |
| Polypropylene | 34 |
| Polyester | 39–42 |
| Polyacrylamide | 35–40 |
| Polyvinyl alcohol | 37 |
| Polymethyl methacrylate | 39 |
| Polyvinyl chloride | 39 |
| Polysulfone | 41 |
| Nylon 6 | 42 |
| Polyurethane | 45 |
| Polycarbonate | 45 |
| Polytetrafluoroethylene | 19 |

The pad material is typically hydrophilic to provide a critical surface tension greater than or equal to 34 milliNewtons per meter, more preferably greater than or equal to 37 and most preferably greater than or equal to 40 milliNewtons per meter. Critical surface tension defines the wettability of a solid surface by noting the lowest surface tension a liquid can have and still exhibit a contact angle greater than zero degrees. Thus, polymers with higher critical surface tensions are more readily wet and are therefore more hydrophilic.

In one embodiment, the pad matrix is derived from the following classes of polymers:

1. an acrylated urethane;
2. an acrylated epoxy;
3. an ethylenically unsaturated organic compound having a carboxyl, benzyl, or amide functionality;
4. an aminoplast derivative having a pendant unsaturated carbonyl group;
5. an isocyanurate derivative having at least one pendant acrylate group;
6. a vinyl ether;
7. a urethane;
8. a urea-urethane;
9. a polyacrylamide;
10. an ethylene/ester copolymer or an acid derivative thereof;
11. a polyvinyl alcohol;
12. a polymethyl methacrylate;
13. a polysulfone;
14. a polyamide;
15. a polycarbonate;
16. a polyvinyl chloride;
17. an epoxy;
18. a copolymer of any of the above polymers; or
19. a combination thereof.

Useful pad materials comprise polyurethane, polycarbonate, polyamide, polysulfone, polyvinyl chloride, polyacrylate, polymethacrylate, polyvinyl alcohol, polyester or polyacrylamide moieties. In a multilayer pad, one or more base layers may be provided and these base layers can be either porous or non-porous, integral with a non-porous surface portion. Typically, a porous base layer has fiber reinforcement. The base layer(s) could be made from a polymer of the same class as the polymer used to make the surface layer. The base layer polymer could have a lower or higher flexural modulus relative to the surface layer material. The surface polymer could also be of a different class than the base layer polymer, and have a flexural modulus at least 10% higher than the flexural modulus of the base layer or the composite of the base layers where more than one base layer is provided. A multi-layer or a single-layer polymeric polishing pad may be used with a base pad to enhance performance. Typically, base pads or sub pads are formed from foamed sheets or felts impregnated with a polymeric material.

In one embodiment, the polishing layer of the polishing pad may comprise: 1. a plurality of rigid domains which resists plastic flow during polishing; and 2. a plurality of less rigid domains which are less resistant to plastic flow during polishing. Such a combination of properties provides a dual mechanism which has been found to be particularly advantageous in the polishing of silicon and metal. The hard domains tend to cause the protrusions in the polishing layer to rigorously engage the surface of the substrate being polished, whereas the soft domains tend to enhance polishing interaction between the protrusions in the polishing layer and the substrate surface being polished.

Other polymers having hard and soft segments could also be appropriate, including ethylene copolymers, copolyester, block copolymers, polysulfone copolymers and acrylic copolymers. Hard and soft domains within the pad material can also be created: 1. by hard (benzene-ring containing) and soft (ethylene containing) segments along a polymer backbone; 2. by crystalline regions and non-crystalline regions within the pad material; 3. by alloying a hard (polysulfone) polymer with a soft (ethylene copolymer, acrylic copolymer) polymer; or 4. by combining a polymer with an organic or inorganic filler. Such compositions include copolymers, polymer blends interpenetrating polymer networks and the like.

In another embodiment, the polishing pad layer may be filled or unfilled to control the void volume percent or porosity. Preferred fillers include, but are not limited to abrasive particles, gases, fluids, any fillers commonly used in polymer chemistry, and inorganic materials (e.g. calcium carbonate) provided they do not unduly interfere with polishing performance. Preferred abrasive particles include, but are not limited to, alumina, ceria, silica, titania, germania, diamond, silicon carbide or mixtures thereof, either alone or interspersed in a friable matrix which is separate from the continuous phase of pad material. For a polyurethane-based pad, void volume fraction, Ø, is calculated utilizing the following formula:

$$Ø=(\sigma_{PU}-\sigma_{IC})/(\sigma_{PU}-\sigma_f)$$

Where, $\sigma_{PU}$=Density of polyurethane/filler mixture, gms/cubic cm.

$\sigma_{IC}$=Density of porous polyurethane standard, gms/cubic cm.

$\sigma_f$=Density of filler material, gms/cubic cm.

Polishing pads can be molded in any desired initial gauge thickness, or machined or skived from a thicker molded section of a predetermined gauge thickness. According to one embodiment, the pads are molded to a thickness requiring no further reduction in the overall dimension, except for some loss in surface due to pre-texturizing. The pads of the present invention can be made by any one of a number of polymer processing methods, such as but not limited to, casting, compression, injection molding (including reaction injection molding), extruding, web-coating, photopolymerizing, extruding, printing (including ink-jet and screen printing), sintering, and the like.

In one embodiment, the pad of this invention comprises a layer wherein the layer is further composed of an overlayer and an underlayer. The overlayer, made of polymeric material, can be deposited on the underlayer by printing or photo-imaging. The underlayer could be made from an inorganic (for e.g. ceramic) material. A micro-texture and macro-texture may be imparted to the overlayer by chemical etching, sintering, furrowing etc.

As discussed previously, the polishing pad of this invention may also be derived from high pressure sintering of thermoplastic polymer powders, preferably at a temperature below the melting point of the polymer(s). The sintering is preferably conducted in a precisely shaped mold to provide a non-densified, porous material having a uniform, continuously interconnected porous surface. Thermoplastic polymers are generally viscoelastic, and their temperature/viscosity behavior can be complex. Polymer behavior over a wide temperature range can be classified into three basic regions. At low temperatures, polymers behave as glassy, brittle solids, exhibiting predominantly elastic behavior. The upper temperature boundary for this region is often referred to as the glass transition temperature or "Tg." Above the Tg, but below the melting point of the polymer, viscous characteristics become more significant and polymers exhibit both viscous and elastic effects. In this region, the polymer is capable of considerable deformation when stress is applied. However, when the stress is removed, complete recovery may not occur, due to permanent movement and rearrangement of the molecular structure of the polymer. Above the melting point, the polymer also tends to behave as a viscous liquid, generally exhibiting permanent deformation when stress is applied. Above the melting point of the polymer, rapid liquid sintering makes the sintering process difficult to control, particularly since a precisely regulated and uniform pore structure is desired. Additionally, above the melting point, thermal gradients tend to cause variations in sintering rate and can cause a non-uniform pore structure in the final article.

The polishing pad can be produced by pressure sintering powder compacts of thermoplastic polymer at a temperature above the glass transition temperature but not exceeding the melting point of the polymer. The sintering process is conducted at a pressure in excess of 100 psi and in a mold having the desired final pad dimensions. In an embodiment, a mixture of two polymer powders is used, where one polymer has a lower melting point than the other. When the mixture is pressure sintered at a temperature not to exceed the melting point of the lower melting powder, the increased stiffness afforded by incorporation of the higher melting polymer component gives improved mechanical strength to the sintered product. Further details may be found in U.S. Pat. No. 6,017,265 which is incorporated here by reference. The sintering conditions and mold surface can be controlled to generate the desired micro-texture on the polishing pad surface.

In one embodiment of the polishing pad, the polishing surface has macro-texture as well as micro-texture. The macro-texture can be either perforations through the pad thickness or surface groove designs. Such surface groove designs include, but are not limited to, circular grooves which may be concentric or spiral grooves, cross-hatched patterns arranged as an X-Y grid across the pad surface, other regular designs such as hexagons, triangles and tire-tread type patterns, or irregular designs such as fractal patterns, or combinations thereof. The groove profile may be rectangular with straight side-walls or the groove cross-section may be "V"-shaped, "U"-shaped, triangular, saw-tooth, etc. Further, the geometric center of circular designs may coincide with the geometric center of the pad or may be offset. Also the groove design may change across the pad surface. The choice of design depends on the material being polished and the type of polisher, since different polishers use different size and shape pads (i.e. circular versus belt). Groove designs may be engineered for specific applications. Typically, these groove designs comprise one or more grooves. Further, grooves on a polishing pad may be provided randomly or according to a specific design or pattern, described previously.

Typical groove patterns have a groove depth in a range of about 0.075 to about 3 mm (more preferably about 0.3 mm to about 1.3 mm, and most preferably about 0.4 mm to 1 mm); a groove width in a range of about 0.125 mm to about 150 mm (more preferably about 0.75 mm to about 5 mm, and most preferably about 1 mm to about 2 mm); and a groove pitch in a range of about 0.5 mm to about 150 mm (more preferably about 3 mm to about 15 mm, and most preferably about 10 mm to about 15 mm). A lower limit to groove pitch is about 0.5 mm. Below this limit grooves become difficult and time consuming to produce. Additionally, below a groove pitch of 0.5 mm, the structural integrity of the projecting surface between grooves (land area) is reduced and tends to deflect or deform during application of the micro-texture.

Preferably the macro-texture features (or grooves) are formed by the mold cavity defined by a preselected design pattern machined into the inner molding die surface. Alternatively, the desired macro-texture features can be etched or cut (using a lathe or milling machine) into an as-molded, or skived pad to form the selected pattern of grooves. Alternately, techniques such as chemical etching with photo-imaging could also be used to create the grooves. The grooves, of the desired designed texture, typically are present in the pad at the stage of manufacture for forming the micro-texture according to this invention.

A surface texture may be imparted to molded polishing pads during the molding operation. Thus a texture may be imparted into a coating on an otherwise smooth mold surface or by modifying the mold surface.

The mold surface may be modified by the following means:

1. Micro-machining the mold surface by grit blasting, wherein the grit comprises sand, glass beads, etc. The grit size is specifically chosen so that the desired texture is obtained. The grit size is preferably in the range of 1 to 500 microns and more preferably in the range of 10 to 100 microns.
2. Micro-machining the mold surface via lathe, milling machine and the like.

The mold surface may also be coated to ensure that a desired texture is imparted to the polishing pad surface. Various techniques available for accomplishing this are as follows:

1. Multiple applications of a homogeneous coating to build up micro-structures on the mold surface.
2. Multiple-component coating with particles to create desired structures on the mold surface.
3. Multi-step coating process wherein an initial coating containing particles to create the desired structure is applied, followed by a conformal coating to serve as the mold release.

The surface micro-texture according to this invention is more preferably imparted to the polishing pad by a direct alteration of the pad surface. In the context of this invention, cutting tool refers to any mechanical means, such as cutting or deforming, chemical means such as etching, radiation techniques such as laser ablation, or any combination of these. Thus cutting refers to material removal from the surface by any means including, but not limited to, direct application of blades, lathe bits, milling cutters, routers, files, rasps, wire brushes (wheels or cups), grinding stones, or tools made from metal, ceramic, polymer, cloth or paper, whose surface is impregnated with an abrasive material (diamond particles, silicon carbide particles, corundum particles, quartz particles, or the like). Cutting also refers to material removal from the surface by impingement of a substance on the surface being altered including, but not limited to, sand blasting, bead blasting, grit blasting, high pressure fluids (such as water, oil, air, or the like) or any combination of these. Plastic deformation refers to permanently altering the surface by any means either accompanied or not accompanied by substantial material removal, including, but not limited to, embossing, calendaring, or furrowing.

Preferred methods for mechanically altering the surface of a polymeric polishing pad are through the use of:

(1) a single-point tool (such as a lathe bit, milling cutter, or the like): (note that multi-toothed lathe bits, multi-end milling tools and the like are considered single point tools in the context of this invention since they have a low fixed number of points of contact with the surface being altered).

(2) a multi-point tool (such as a wire brush (wheel or cup), a material whose surface is impregnated with an abrasive material, a grinding stone, a rasp, belt sander and the like): (note that a multi-point tool in the context of this invention has numerous distributed points of contact with the surface being altered).

(3) a combination of (1) and (2) above, used either simultaneously or sequentially.

The micro-texture formed by the above methods is believed to be formed by a combination of (a) material removal (cutting, tearing of the surface, or furrowing), and (b) plastic deformation of the surface either accompanied by material removal (for e.g. furrowing) or not accompanied by material removal (for e.g. embossing). It is critical in all methods that a minimum of 2 $\mu$m depth of the polishing pad surface (polishing layer) be removed or altered to provide the micro-texture.

Figure 2:
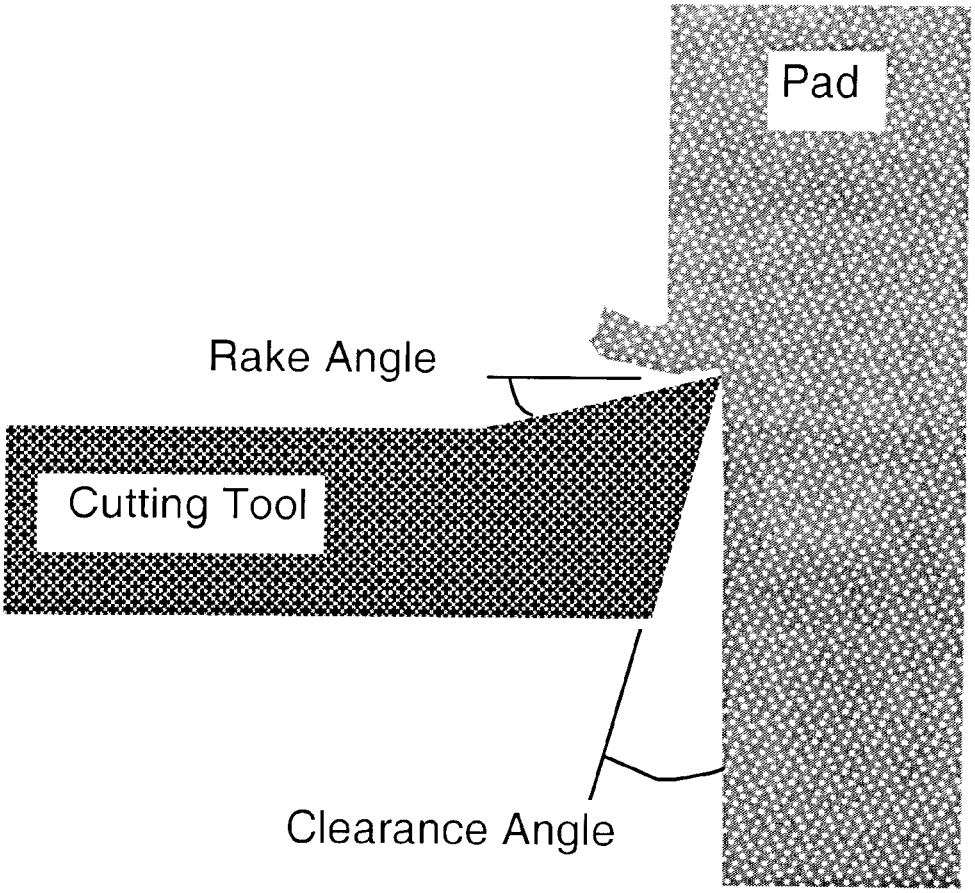
FIG. 2 is a schematic of a single-point cutting tool used to create micro-texture according to the present invention.

In one embodiment, the micro-texture formed by method (1) employs a custom-engineered single-point high-speed cutting tool. FIG. 2 is a schematic of a single-point custom-engineered high-speed cutting tool. The cutting end of the tool is in the shape of an arc, with a preferred radius between 0.2 mm and 500 mm. A specific micro-texture may be obtained by varying the rake and clearance angles of the tool: preferred rake angles are between 0° and 60°, and preferred clearance angles are between 0° and 60°. In a preferred embodiment, the cutting tool is moved linearly across the surface of the pad while the pad is being rotated. The peak to valley height, h, is controlled through a combination of the tool's radius, r, and the feed rate of the tool across the pad as it is rotated, FR, (FR is specified by distance traveled per revolution of the pad.)

$$h=r-\sqrt{r^2-(FR^2/4)}$$

This technique creates a predominant furrowed texture. The furrows can be concentric circles single spirals, or overlapping spirals, and the pattern may be either centered or not centered on the pad, or any combination thereof. The texture can be created with furrows all of the same depth or with multiple depths.

In another embodiment, the micro-texture formed by method (2) employs a disc shaped, multi-point diamond-impregnated abrasive tool. The cutting tool depicted in FIG. 2, can be shaped to provide a multi-point abrading surface containing blocky-shaped diamond grit in the size range of 40 to 400 mesh, wherein the abrading surface is a 1 cm wide ring with an outside diameter of 10 cm. Diamond impregnated tools may be specially ordered from Mandall Armor Design and Mfg., Inc, based in Phoenix, Ariz.

Depending on the abrasive particle size and distribution, pad surface temperature and inherent hardness of the polymeric material, obtaining a defined micro-texture depends on the velocity of the tool relative to the pad surface undergoing pre-treatment and the pressure with which the tool is applied to the pad. In an embodiment a constant ratio of tool-to-pad surface velocity in the range of 0 to 100 is provided.

Figure 3:
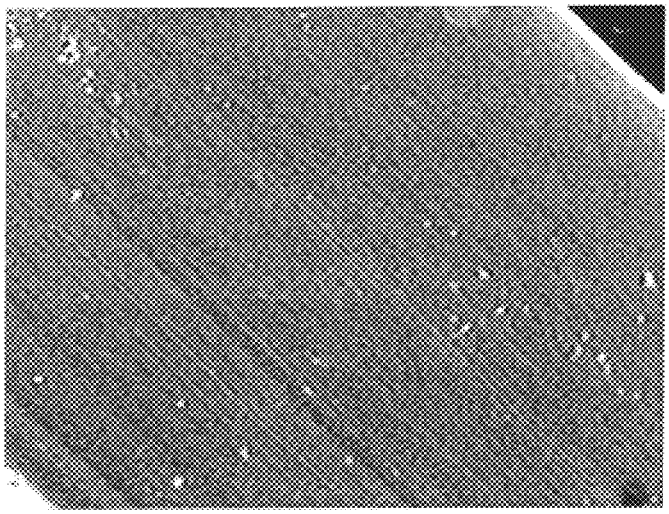
FIG. 3 is a scanning electron micrograph (SEM) at 200× magnification of the working surface of an as-manufactured, homogeneous, non-porous polishing pad without any micro-texture.
Figure 4:
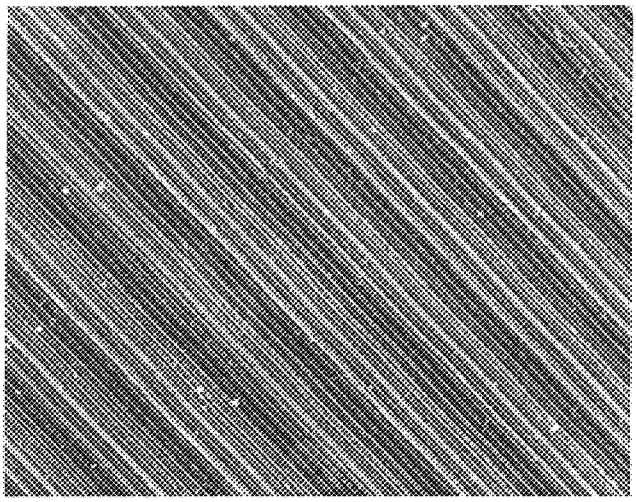
FIG. 4 is an SEM at 200× magnification of the surface of an as-manufactured pad having a micro-texture utilizing a custom-engineered single-point cutting tool on a lathe.
Figure 5:
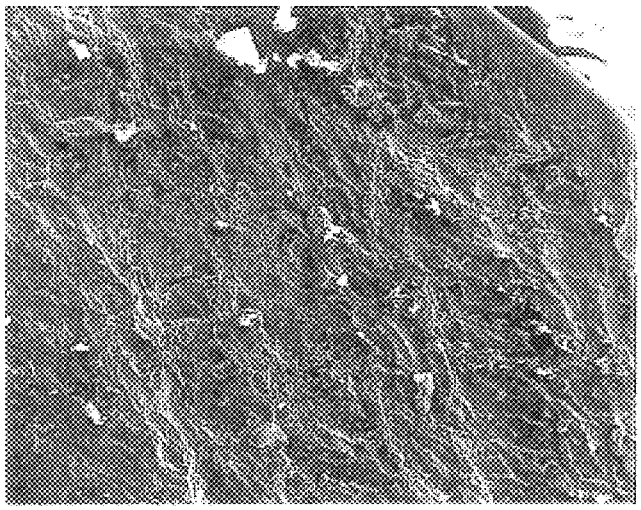
FIG. 5 shows the surface texture created by a multipoint tool.

Before application of a surface treatment method, the surface of an as-manufactured molded polymeric pad of prior art is essentially smooth and devoid of micro-texture as shown in FIG. 3. The surface texture created by method (1) contains a uniform and well defined set of peaks (also referred to herein as protrusions) and valleys (also referred to herein as indentations) over all of the polishing surface, as shown in FIG. 4. The surface texture created by method (2) contains a statistically uniform distribution of randomly shaped and sized peaks and valleys over all of the polishing surface, as shown in FIG. 5.

The micro-texture is formed uniformly on and over the surface (or polishing layer) of the polishing pad. The surface of as-manufactured pads, with suitable micro-texture, which results in improved break-in time is characterized as follows:

Average Arithmetic Surface Roughness, Ra, from 0.01 $\mu$m to 25 $\mu$m;

Average Peak to Valley Roughness, Rtm, from 2 $\mu$m to 40 $\mu$m;

Core roughness depth, Rk, from 1 to 10;

Reduced Peak Height, Rpk, from 0.1 to 5;

Reduced Valley Height, Rvk, from 0.1 to 10; and

Peak density expressed as a surface area ratio, $R_{SA}$, ([Surf.Area/(Area−1)]), 0.001 to 2.0.

Pads with micro-texture generated according to this invention may be used for polishing with conventional abrasive containing slurries or abrasive-free slurries. The term polishing fluid is used herein to encompass various types of slurries. Abrasive free-slurries are also referred to as reactive liquids. Preferred abrasive particles include, but are not limited to, alumina, ceria, silica, titania, germania, diamond, silicon carbide or mixtures thereof. The reactive liquid may also contain oxidizers, chemicals enhancing solubility of the substrate being polished (including chelating or complexing agents), and surfactants. Slurries containing abrasives also have additives such as organic polymers which keep the abrasive particles in suspension.

One problem associated with chemical-mechanical polishing is determining when the substrate (e.g. wafer) has been polished to the desired degree of flatness. Conventional methods for determining a polishing endpoint require that the polishing operation be stopped and that the wafer be removed from the polishing apparatus so that dimensional characteristics can be determined. Stopping the operation impacts the rate of wafer production. Further, if a critical wafer dimension is found to be below a prescribed minimum, the wafer may be unusable, thereby leading to higher scrap rates and production costs. Thus determining the polishing endpoint is critical to chemical mechanical polishing.

The polymeric material used to make the polishing pad of this invention may have a region wherein the polymeric material is opaque and an adjacent region wherein the polymeric material is transparent. The transparent region of the polishing pad is sufficiently transmissive to an incident radiation beam used for polishing endpoint detection to pass through the polishing pad.

Types of polymeric material suitable for making a polishing pad with an integral window for endpoint detection include polyurethanes, acrylics, polycarbonates, nylons and polyesters, it is possible to make a transparent window out of polyvinyl chlorides, polyvinylidene fluorides, polyether sulfones, polystyrenes, polyethylenes and polytetrafluoroethylenes.

Transparent and opaque regions within the same polishing pad can be made either by a single semi-crystalline thermoplastic material, a blend of thermoplastic materials, and/or a reactive thermosetting polymer. One method for making such polishing pads is molding wherein the flowable polymeric material is transparent. Rapid cooling of the flowable polymeric material results in a hardened transparent polymeric material. Slow cooling of the flowable polymeric material results in an opaque polymeric material. Semi-crystalline thermoplastic polymers are generally transparent when in liquid phase but become opaque after curing because they contain both crystalline and amorphous phases, the crystalline phase causes light-scattering which makes the polymer opaque. Crystallization occurs at temperatures between the melting temperature ($T_{melt}$) and the glass transition temperature ($T_g$) of the polymer, these being the upper and lower crystallization temperatures, respectively. If a semi-crystalline polymer is rapidly cooled from a temperature above $T_{melt}$ to a temperature below $T_g$, crystallization can be minimized, and the polymer will remain amorphous and transparent. Alternatively, crystallization can be controlled by rapid cooling in order to keep the resulting crystallite to a size which is too small to scatter light, whereby the polymer will remain transparent.

Another suitable type of polymeric material for making the pad comprises a blend of two thermoplastic polymers. Again it is possible to control opacity by controlling cooling rates in different regions of the mold. Polymer blends typically have temperature ranges within which they are either miscible (single phase and transparent) or immiscible (incompatible and opaque). An example of such a system is poly (phenylene oxide)—polystyrene blends. These two polymers are completely miscible at elevated temperature. A slow cooling of the blend allows phase separation and opacity develops. However, rapid cooling will freeze-in the transparent single phase structure. By transparent it is meant that the polymeric material exhibits transmissivity on the order of 20% or more to an incident light beam having some wavelength in the range from infrared to ultra-violet, at least when the light beam is at an angle of incidence substantially normal to the surface of the polishing pad. It should be understood that the transparent region need not be totally transmissive, and that some scattering of incident light, particularly due to surface finish of the transparent region, is acceptable.

Another suitable type of polymeric material comprises a reactive thermosetting polymer which forms phase separated micro-domains. Such a polymer comprises a polyol and a polydiamine which are mixed and reacted with an isocyanate.

A polishing pad molded as a one-piece article with an integral, transparent window, reduces manufacturing steps and associated costs. The possibility of slurry leakage around the window is eliminated. The window is coplanar with the polishing surface so that a surface of the window can participate in the polishing. Since the window is made from the same polymer formulation as the rest of the pad, the window has the same physical properties as the pad. Therefore, the window has the same conditioning and polishing characteristics and the same hydrolytic stability as the pad. Further, thermal expansion mismatch between the pad and the window is avoided. Further details may be found in U.S. Pat. No. 5,605,760 which is incorporated here by reference.

The pad of the present invention can be used for polishing the surface of a substrate (workpiece). In polishing use, the pad is mounted on a polishing apparatus equipped with a holding or retention apparatus as a mounting means for mounting and securing the workpiece to the polishing apparatus. A separate means is provided for securing the polishing pad as described herein to the polishing apparatus. A drive means is provided for moving the workpiece and/or the pad relative to each other along with a means for applying and maintaining a compressive force on the workpiece to hold it against the polishing pad. The workpiece mounting means includes but is not limited to, a clamp, a set of clamps, a mounting frame attachable to the workpiece and the polishing apparatus; a platen equipped with perforations connected to a vacuum pump to hold the polishing pad; or an adhesive layer to hold the polishing pad on the platen and the workpiece to the carrier. Polishing includes biasing the substrate to be polished against the polishing surface of the pad, and applying a polishing fluid with or without abrasive particles and other chemicals (complexing agents, surfactants, etc.) between the article and polishing pad. Polishing is effected by lateral motion of the substrate relative to the polishing pad. The motion may be linear or circular or a combination thereof. The initial micro-texture provided on the polishing pad surface may be regenerated during polishing use of the pad, if necessary, by mechanical means for forming micro-texture, mounted on the polishing apparatus. The mechanical means is typically a 100-grit conditioning disk supplied by Abrasive Technology, Inc. The micro-texture reconditioning step is preferably performed at intervals during the polishing process, either during the step of applying the substrate against the pad, or more preferably during intervals when the substrate is disengaged from the pad. A suitable polishing apparatus equipped with a means for re-conditioning the pad surface (to regenerate micro-texture) is disclosed in U.S. Pat. No. 5,990,010. Polishing can be terminated when the substrate achieves the desired degree of flatness utilizing end-point detection via the integral window provided in the polishing pad of this invention.

EXAMPLE 1

Prior Known Pad

A 24 in. diameter×0.052 in. thick polishing pad made according to Example 1 of U.S. Pat. No. 6,022,268 was tested. This pad is representative of a prior known prior art as-manufactured, non-preconditioned solid polymeric polishing pads.

The pad contained a molded-in macro-texture consisting of concentric grooves having a depth of 0.38 mm, a groove width of 0.25 mm and a land width (the projecting pad surface between grooves) of 0.51 mm. The pad was used to polish a series of thermal oxide (TOX) silicon wafers using an AMAT Mirra polishing machine (supplied by Applied Materials, Inc.) with ILD 1300 as the polishing slurry. ILD 1300 is a colloidal silica polishing slurry available from Rodel, Inc, based in Newark, Del.

The polishing conditions used were: pressure, 4 p.s.i.; platen speed of 93 rpm; carrier speed of 87 rpm; and a slurry flow rate of 150 ml/min. The removal rate was monitored during polishing and is plotted in FIG. 6 against accumulated polishing time. The initial polishing removal rate was about 1,500 Angstroms per minute, and attained a steady state value of 2,000 Angstroms per minute after 40 minutes of polishing time.

EXAMPLE 2

Pad of this Invention

An as-manufactured prior known pad identical to Example 1 was further processed by providing a micro-texture to the pad surface. The micro-texture was created by utilizing an Ikegai, Model AX4ON lathe and a lathe bit made from high-speed tool steel with an end radius normal to the direction of the cutting surface of 0.5 mm, a rake angle of 15°, and a clearance angle of 5°, mounted in a standard bit holder. The tool was applied to the pad surface at a cut depth of 0.013 mm and translated in one pass on a linear path across the pad surface along the equator. The speed controller adjusted the rotational speed of the pad to maintain a constant tool velocity relative to the pad (in the azimuthal direction) of 6 meters/min. Cutting debris was removed using a 3.5 HP Sears Craftsman Wet/Dry Vacuum.

The micro-texture of the projecting surface, between macrogrooves was measured after pretreatment of the pad using a ZYGO New View 5000, white light interferometer with a 10× Objective lens, a 1× Zoom lens, and a magnification of 200×. The scan area on the pad sample was 250 square millimeters (500 $\mu$m×500 $\mu$m).

The surface characteristics of the polishing pad of this example were as follows:

Average Arithmetic Surface Roughness, Ra, of 1.6 $\mu$m;
Average Peak to Valley Roughness, Rtm, of 6.3 $\mu$m;
Core roughness depth, Rk, of 2.7 $\mu$m;
Reduced Peak Height, Rpk, from 0.97 $\mu$m;
Reduced Valley Height, Rvk, of 1.8 $\mu$m; and
Peak density expressed as a surface area ratio, $R_{SA}$, ([Surf.Area/(Area−1)]), of 0.023.

Polishing conditions during this experiment were identical to Example 1. The removal rate was monitored again during polishing as a function of polishing time. As shown in FIG. 6, the initial removal rate was about 1,430 Angstroms per minute, and reached a steady-state value of 2,000 Angstroms per minute after 20 minutes of accumulated polishing time. Thus the pad of this invention yielded a 50% reduction in break-in time, i.e. a 50% reduction in polishing time required to attain a stable removal rate.

EXAMPLE 3

Pad of this Invention

An as-manufactured prior art pad identical to Example 1 was further processed by providing a micro-texture to the pad surface. An Ikegai, Model AX4ON lathe was used in this experiment. The micro-texture was created by utilizing a 10.16 cm diameter stainless steel disk whose outer 1 cm was impregnated with 80/100 mesh diamond grit, mounted on a separate movable rotating chuck operatively connected to a pneumatic pressure cylinder. The lathe and disk assembly were coupled to a computerized speed controller which was pre-set to maintain a constant ratio of velocity between the tool and pad of 2.5 to 1. The tool was applied to the pad surface with a constant pressure of 138 kPa and translated in one pass on a linear path across the pad surface along the equator. The speed controller adjusted the rotational speed of the pad continuously, and thus compensated for the slower pad speed as the disk approached the center of the pad, and the increasing speed as the disk moved outward from the pad center, so as to maintain the constant ratio. A stream of ambient air was directed on the rotating pad as a means of cooling. Cutting debris was removed using a 3.5 HP Sears Craftsman Wet/Dry Vacuum.

The micro-texture of the projecting surface, between macrogrooves was measured after pretreatment of the pad using a ZYGO New View 5000, white light interferometer with a 10× Objective lens, a 1× Zoom lens, and a magnification of 200×. The scan area on the pad sample was 250 square millimeters (500 μm×500 μm).

The surface characteristics of the polishing pad of this invention were as follows:

Average Arithmetic Surface Roughness, Ra, of 1.9 μm;
Average Peak to Valley Roughness, Rtm, of 17.1 μm;
Core roughness depth, Rk, of 4.2 μm;
Reduced Peak Height, Rpk, from 2.9 μm;
Reduced Valley Height, Rvk, of 3.6 μm; and
Peak density expressed as a surface area ratio, $R_{SA}$, ([Surf.Area/(Area−1)]), of 0.265.

What is claimed is:

1. A polishing pad, comprising:

a layer having a polishing surface with a micro-texture; said micro-texture being characterized by:

i. a land surface roughness, Ra, from about 0.01 μm to about 25 μm;

ii. a peak to valley roughness, Rtm, from about 2 μm to about 40 μm;

iii. a core roughness depth, Rk, from about 1 to about 10;

iv. a reduced peak height, Rpk, from about 0.1 to about 5;

v. a reduced valley height, Rvk, from about 0.1 to 10; and vi. a peak density, $R_{sa}$, from about 0.001 to about 2.0.

2. A polishing pad according to claim 1 wherein said layer is generated by molding or sintering of organic material.

3. A polishing pad according to claim 2 wherein said micro-texture is formed by chemical etching, photo-imaging or a combination thereof.

4. A polishing pad according to claim 1 wherein said layer further comprises an organic overlayer on an underlayer; said overlayer being deposited on said underlayer by printing or photo-imaging.

5. A polishing pad according to claim 1 with said pad having a molded belt configuration.

6. A polishing pad according to claim 2 wherein said layer has a thickness in a range of about 500 to 2,600 micrometers.

7. A polishing pad according to claim 6 wherein the organic material is selected from a group consisting of thermoplastic materials, thermosetting materials or a combination thereof.

8. A polishing pad according to claim 7 wherein said organic material is a polymer selected from a group consisting of polyurethane, polyurea-urethane, polycarbonate, polyamide, polyacrylate and polyester.

9. A polishing pad according to claim 8 wherein the polymer layer has a percent void volume in a range of about 0 to 20%.

10. A polishing pad according to claim 9 wherein the polymer layer has transparent and opaque regions.

11. A polishing pad of claim 10 wherein the polymeric material in the transparent region is in a semi-crystalline phase and has a crystallite size that is too small to scatter light.

12. A polishing pad according to claim 11 wherein the transparent region is transparent to light having a wavelength within the range of 190 to 3,500 nanometers.

13. A polishing pad according to claim 12 wherein the polishing surface micro-texture is generated by a cutting tool and a cutting debris removal system.

14. A polishing pad according to claim 13 wherein the cutting tool is a single-point tool fixedly attached to a lathe to enable movement of the single-point tool over the polymer layer of the polishing pad at a tool to pad velocity ratio in the range of 1 to 10.

15. A polishing pad according to claim 13 wherein the cutting tool is a multi-point tool fixedly attached to a lathe to enable movement of the multi-point tool over the polymer layer of the polishing pad at a tool to pad velocity ratio in the range of 1 to 10.

16. A polishing pad according to claim 14 wherein the single-point tool is a blade.

17. A polishing pad according to claim 15 wherein the multi-point tool is a diamond disk.

18. A polishing pad according to claim 13 wherein said polishing layer further comprises a macro-texture having a groove pattern with one or more grooves; said groove pattern having:

i. a groove depth of about 0.075 to about 3 millimeters;

ii. a groove width of about 0.125 to about 150 millimeters; and iii. a groove pitch of about 0.5 to about 150 millimeters;

with said groove pattern being random, concentric, spiral, cross-hatched, X-Y grid, hexagonal, triangular, fractal or a combination thereof.

19. A polishing pad according to claim 13 wherein said polishing layer further comprises a macro-texture having a groove pattern with one or more grooves; said groove pattern having:

i. a groove depth of about 0.3 to about 1.3 millimeters;

ii. a groove width of about 0.75 to about 5 millimeters; and iii. a groove pitch of about 3 to about 15 millimeters;

with said groove pattern being random, concentric, spiral, cross-hatched, X-Y grid, hexagonal, triangular, fractal or a combination thereof.

20. A polishing pad according to claim 13 wherein said polishing layer further comprises a macro-texture having a groove pattern with one or more grooves; said groove pattern having:

i. a groove depth of about 0.4 to about 1 millimeters;

ii. a groove width of about 1 to about 2 millimeters; and iii. a groove pitch of about 10 to 15 millimeters;

with said groove pattern being random, concentric, spiral, cross-hatched, X-Y grid, hexagonal, triangular, fractal or a combination thereof.

21. A polishing pad according to claim 18 wherein the polishing surface has a micro-texture characterized by:

i. a land surface roughness, Ra, from about 0.2 μm to about 5 μm;

ii. an average peak to valley roughness, Rtm, from about 2 μm to about 10 μm;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

22. A polishing pad according to claim 21 wherein the polymer layer has a percent void volume in a range of about 0 to 5%.

23. A polishing pad according to claim 22 wherein the polishing surface has a micro-texture characterized by:

i. an average land surface roughness, Ra, of 1.5 μm;

ii. an average peak to valley roughness, Rtm, of 6 μm;

iii. an average core roughness depth, Rk, of 3.0 μm;

iv. an average reduced peak height, Rpk, of 1.0 μm;

v. an average reduced valley height, Rvk, of 1.0 μm; and vi. an average peak density, $R_{sa}$, of 0.03 μm.

24. A polishing pad according to claim 19 wherein the polishing surface has a micro-texture characterized by:

i. a land surface roughness, Ra, from about 0.2 μm to about 5 μm;

ii. an average peak to valley roughness, Rtm, from about 2 μm to about 10 μm;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

25. A polishing pad according to claim 24 wherein the polymer layer has a percent void volume in a range of about 0 to 5%.

26. A polishing pad according to claim 25 wherein the polishing surface has a micro-texture characterized by:

i. an average land surface roughness, Ra, of 1.5 μm;

ii. an average peak to valley roughness, Rtm, of 6 μm;

iii. an average core roughness depth, Rk, of 3.0 μm;

iv. an average reduced peak height, Rpk, of 1.0 μm;

v. an average reduced valley height, Rvk, of 1.0 μm; and vi. an average peak density, $R_{sa}$, of 0.03 μm.

27. A polishing pad according to claim 20 wherein the polishing surface has a micro-texture characterized by:

i. a land surface roughness, Ra, from about 0.2 μm to about 5 μm;

ii. an average peak to valley roughness, Rtm, from about 2 μm to about 10 μm;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

28. A polishing pad according to claim 27 wherein the polymer layer has a percent void volume in a range of about 0 to 5%.

29. A polishing pad according to claim 28 wherein the polishing surface has a micro-texture characterized by:

i. an average land surface roughness, Ra, of 1.5 μm;

ii. an average peak to valley roughness, Rtm, of 6 μm;

iii. an average core roughness depth, Rk, of 3.0 μm;

iv. an average reduced peak height, Rpk, of 1.0 μm;

v. an average reduced valley height, Rvk, of 1.0 μm; and vi. an average peak density, $R_{sa}$, of 0.03 μm.

30. A polishing pad according to claim 14 wherein said polishing layer further comprises a macro-texture having a groove pattern with one or more grooves; said groove pattern having:

i. a groove depth of about 0.075 to about 3 millimeters;

ii. a groove width of about 0.125 to about 150 millimeters; and iii. a groove pitch of about 0.5 to about 150 millimeters;

with said groove pattern being random, concentric, spiral, cross-hatched, X-Y grid, hexagonal, triangular, fractal or a combination thereof.

31. A polishing pad according to claim 30 wherein said polishing surface has a micro-texture characterized by:

i. a land surface roughness, Ra, from about 0.2 μm to about 5 μm;

ii. an average peak to valley roughness, Rtm, from about 2 μm to about 10 μm;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

32. A polishing pad according to claim 31 wherein the polymer layer has a percent void volume in the range of 0 to 5%.

33. A polishing pad according to claim 32 wherein said polishing surface has a micro-texture characterized by:

i. an average land surface roughness, Ra, of 1.5 μm;

ii. an average peak to valley roughness, Rtm, of 6 μm;

iii. an average core roughness depth, Rk, of 3 μm;

iv. an average reduced peak height, Rpk, of 1 μm;

v. an average reduced valley height, Rvk, of 1 μm; and vi. an average peak density, $R_{sa}$, of 0.03.

34. A polishing pad according to claim 15 wherein said polishing layer further comprises a macro-texture having a groove pattern with one or more grooves; said groove pattern having:

i. a groove depth of about 0.075 to about 3 millimeters;

ii. a groove width of about 0.125 to about 150 millimeters; and iii. a groove pitch of about 0.5 to about 150 millimeters;

with said groove pattern being random, concentric, spiral, cross-hatched, X-Y grid, hexagonal, triangular, fractal or a combination thereof.

35. A polishing pad according to claim 34 wherein said surface has a micro-texture characterized by:

i. a land surface roughness, Ra, from about 0.2 μm to about 5 μm;

ii. an average peak to valley roughness, Rtm, from about 2 μm to about 10 μm;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

36. A polishing pad according to claim 35 wherein the polymer layer has a percent void volume in the range of 0 to 5%.

37. A polishing pad according to claim 36 wherein said polishing surface has a micro-texture characterized by:

i. an average land surface roughness, Ra, of 1.5 μm;

ii. an average peak to valley roughness, Rtm, of 6 μm;

iii. an average core roughness depth, Rk, of 3.0 μm;

iv. an average reduced peak height, Rpk, of 1.0 μm;

v. an average reduced valley height, Rvk, of 1.0 μm; and vi. an average peak density, $R_{sa}$, of 0.03 μm.

38. A polishing pad according to claim 16 wherein said polishing layer further comprises a macro-texture having a groove pattern with one or more grooves; said groove pattern having:

i. a groove depth of about 0.075 to about 3 millimeters;

ii. a groove width of about 0.125 to about 150 millimeters; and iii. a groove pitch of about 0.5 to about 150 millimeters;

with said groove pattern being random, concentric, spiral, cross-hatched, X-Y grid, hexagonal, triangular, fractal or a combination thereof.

39. A polishing pad, according to claim 38, wherein said surface has a micro-texture characterized by:

i. a land surface roughness, Ra, from about 0.2 $\mu$m to about 5 $\mu$m;

ii. an average peak to valley roughness, Rtm, from about 2 $\mu$m to about 10 $\mu$m;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

40. A polishing pad according to claim 39 wherein the percent void volume is in a range of 0 to 5%.

41. A polishing pad, according to claim 40, wherein said surface has a micro-texture characterized by:

i. an average land surface roughness, Ra, of 1.5 $\mu$m;

ii. an average peak to valley roughness, Rtm, of 6 $\mu$m;

iii. an average core roughness depth, Rk, of 3.0 $\mu$m;

iv. an average reduced peak height, Rpk, of 1.0 $\mu$m;

v. an average reduced valley height, Rvk, of 1.0 $\mu$m; and vi. an average peak density, $R_{sa}$, of 0.03 $\mu$m.

42. A polishing pad according to claim 17 wherein said polishing layer further comprises a macro-texture having a groove pattern with one or more grooves; said groove pattern having:

i. a groove depth of about 0.075 to about 3 millimeters;

ii. a groove width of about 0.125 to about 150 millimeters; and iii. a groove pitch of about 0.5 to about 150 millimeters;

with said groove pattern being random, concentric, spiral, cross-hatched, X-Y grid, hexagonal, triangular, fractal or a combination thereof.

43. A polishing pad, according to claim 42, wherein said surface has a micro-texture characterized by:

i. a surface roughness, Ra, from about 0.2 $\mu$m to about 5 $\mu$m;

ii. an average peak to valley roughness, Rtm, from about 2 $\mu$m to about 10 $\mu$m;

iii. a core roughness depth, Rk, from about 1 to about 7;

iv. a reduced peak height, Rpk, from about 0.3 to about 2.5;

v. a reduced valley height, Rvk, from about 0.1 to 3; and vi. a peak density, $R_{sa}$, from about 0.01 to about 0.05.

44. A polishing pad according to claim 43 wherein the percent void volume is in a range of 0 to 5%.

45. A polishing pad according to claim 44 wherein said surface has a micro-texture characterized by:

i. an average land surface roughness, Ra, of 1.5 $\mu$m;

ii. an average peak to valley roughness, Rtm, of 6 $\mu$m;

iii. an average core roughness depth, Rk, of 3.0 $\mu$m;

iv. an average reduced peak height, Rpk, of 1.0 $\mu$m;

v. an average reduced valley height, Rvk, of 1.0 $\mu$m; and vi. an average peak density, $R_{sa}$, of 0.03 $\mu$m.

46. A polishing pad according to claim 4 wherein said underlayer is comprised of a ceramic material.

47. A polishing pad according to claim 4 wherein said overlayer has a thickness in a range of about 500 to 2,600 micrometers.

* * * * *

UNITED STATES PATENT AND TRADEMARK OFFICE

CERTIFICATE OF CORRECTION

PATENT NO. : 6,641,471 B1
APPLICATION NO. : 09/693401
DATED : November 4, 2003
INVENTOR(S) : Pinheiro et al.

It is certified that error appears in the above-identified patent and that said Letters Patent is hereby corrected as shown below:

Please delete Column 15, line 24, through column 20, line 33 (Claims 1 to 47).

Please insert (Claims 1 to 10):

1. A polishing pad useful for polishing semiconductor wafers, comprising: a non-porous layer having a conditioned polishing surface, the conditioned polishing surface having a micro-texture, the micro-texture including:
   - i. a land surface roughness, Ra, from about 0.01 μm to about 25 μm;
   - ii. a peak to valley roughness, Rtm, from about 2 μm to about 40 μm;
   - iii. a core roughness depth, Rk, from about 1 to about 10 μm;
   - iv. a reduced peak height, Rpk, from about 0.1 to about 5 μm;
   - v. a reduced valley height, Rvk, from about 0.1 to 10 μm; and
   - vi. a peak surface area ratio, $R_{sa}$, from about 0.001 to about 2.0.

2. The polishing pad according to claim 1 wherein the organic material is a polymer selected from a group consisting of polyurethane, polyurea-urethane, polycarbonate, polyamide, polyacrylate and polyester.

3. The polishing pad according to claim 1 wherein the polishing surface micro-texture is generated by a cuffing tool and a cuffing debris removal system.

4. The polishing pad according to claim 1 wherein the cuffing tool is a single-point tool fixedly attached to a lathe to enable movement of the single-point tool over the polymer layer of the polishing pad at a tool to pad velocity ratio in the range of 1 to 10.

5. The polishing pad according to claim 4 wherein the single-point tool is a blade.

6. The polishing pad according to claim 1 wherein the cuffing tool is a multi-point tool fixedly attached to a lathe to enable movement of the multi-point tool over the polymer layer of the polishing pad at a tool to pad velocity ratio in the range of 1 to 10.

7. The polishing pad according to claim 6 wherein the multi-point tool is a diamond disk.

UNITED STATES PATENT AND TRADEMARK OFFICE

CERTIFICATE OF CORRECTION

PATENT NO. : 6,641,471 B1
APPLICATION NO. : 09/693401
DATED : November 4, 2003
INVENTOR(S) : Pinheiro et al.

It is certified that error appears in the above-identified patent and that said Letters Patent is hereby corrected as shown below:

Please insert (Claims 1 to 10): (cont'd)

8. The polishing pad according to claim 1 wherein the polishing layer further comprises a macro-texture having a groove pattern with one or more grooves; the groove pattern having:

i. a groove depth of about 0.075 to about 3 millimeters;
ii. a groove width of about 0.125 to about 150 millimeters; and
iii. a groove pitch of about 0.5 to about 150 millimeters;

with the groove pattern being from the group consisting of random, concentric, spiral, cross-hatched, X-Y grid, hexagonal, triangular, fractal and combinations thereof.

9. The polishing pad according to claim 1 wherein the polishing layer further comprises a macro-texture having a groove pattern with one or more grooves; the groove pattern having:

i. a groove depth of about 0.3 to about 1.3 millimeters;
ii. a groove width of about 0.75 to about 5 millimeters; and
iii. a groove pitch of about 3 to about 15 millimeters;

with the groove pattern being from the group consisting of random, concentric, spiral, cross-hatched, X-Y grid, hexagonal, triangular, fractal and combinations thereof.

10. The polishing pad according to claim 1 wherein the polishing layer further comprises a macro-texture having a groove pattern with one or more grooves; the groove pattern having:

i. a groove depth of about 0.4 to about 1 millimeters;
ii. a groove width of about 1 to about 2 millimeters; and
iii. a groove pitch of about 10 to 15 millimeters;

with the groove pattern being from the group consisting of random, concentric, spiral, cross-hatched, X-Y grid, hexagonal, triangular, fractal and combinations thereof.

UNITED STATES PATENT AND TRADEMARK OFFICE

CERTIFICATE OF CORRECTION

PATENT NO. : 6,641,471 B1
APPLICATION NO. : 09/693401
DATED : November 4, 2003
INVENTOR(S) : Pinheiro et al.

It is certified that error appears in the above-identified patent and that said Letters Patent is hereby corrected as shown below:

Please insert (Claims 1 to 10): (cont'd)

i. the surface roughness, Ra, from about 0.2 μm to about 5 μm;
ii. the average peak to valley roughness, Rtm, from about 2 μm to about 10 μm;
iii. the core roughness depth, Rk, from about 1 to about 7 μm;
iv. the reduced peak height, Rpk, from about 0.3 to about 2.5 μm;
v. the reduced valley height, Rvk, from about 0.1 to 3 μm; and
vi. the peak surface area ratio, $R_{sa}$, from about 0.01 to about 0.05.

Signed and Sealed this

Fourth Day of September, 2007

JON W. DUDAS
*Director of the United States Patent and Trademark Office*